United States Patent [19]

Engelman

[11] Patent Number: 4,834,449

[45] Date of Patent: May 30, 1989

[54] COLLAPSIBLE TABLE ASSEMBLY

[76] Inventor: Fred Engelman, 157 Pine Tree Rd., Ocean City, Md. 21842

[21] Appl. No.: 182,857

[22] Filed: Apr. 18, 1988

[51] Int. Cl.[4] ..... A47B 39/04

[52] U.S. Cl. ..... 297/145; 297/150; 297/162; 108/134

[58] Field of Search ..... 108/79, 134, 152; 211/1.3, 104; 248/240.1; 297/150, 162, 194, 145

[56] References Cited

U.S. PATENT DOCUMENTS

| | | | |
|---|---|---|---|
| Re. 23,996 | 5/1955 | Sieminski | 108/48 |
| 2,489,861 | 11/1949 | Ciraolo | 297/194 |
| 2,518,381 | 8/1950 | Runkles | 297/145 |
| 2,538,823 | 1/1951 | Yodice et al. | 297/194 |
| 2,639,761 | 5/1953 | Schenzinger et al. | 108/79 |
| 2,716,044 | 8/1955 | Overby | 108/134 |
| 3,285,206 | 11/1966 | Hoffman | 108/134 |
| 3,632,161 | 1/1972 | Arfaras et al. | 297/194 |

FOREIGN PATENT DOCUMENTS

| | | | |
|---|---|---|---|
| 995245 | 11/1951 | France | 297/145 |

*Primary Examiner*—Kenneth J. Dorner
*Assistant Examiner*—Brian K. Green
*Attorney, Agent, or Firm*—Eric P. Schellin

[57] ABSTRACT

A collapsible table capable of being supported either in an obvious location such as being mounted on a wall or in a somewhat hidden location such as in the arm of a furniture structure such as a chair, couch, etc. A base is fixed to the supporting wall or furniture piece structure and a carriage member is slidably movable thereon. A table top is pivotal relative to the carriage but movable therewith relative to the base so that the table top may selectively be disposed in an operative, substantially horizontal orientation or in an inoperative, stored location. A top support structure is also carried by the carriage and is selectively positionable beneath and in supporting relation to an under surface of the table top.

1 Claim, 3 Drawing Sheets

COLLAPSIBLE TABLE ASSEMBLY

BACKGROUND OF THE INVENTION

1. Field of the Invention

This invention relates to a collapsible table wherein a table top comprising one or more table top segments is first slidable relative to a supporting base out of its stored position and then pivoted relative to a carriage structure into an operative, substantially horizontal orientation for use.

2. Description of the Prior Art

Collapsible table tops of varying sizes, shapes, configurations, etc. are well-known in the prior art and demonstrated in numerous existing U.S. patents. Such patents include but certainly not limited to U.S. Pat. Nos. 132,027; 2,661,258; 3,456,600; 3,456,601; 3,520,259; 3,285,206 and 3,332,373. While the collapsible structures shown in the aforementioned U.S. patents are all considered to be operable for their intended function, there is a feature substantially common to all of said structures. This common feature relates to a permanently anchored base or supporting member to which the collapsible table top is mounted. As is clear in the structures of the above-noted patents as well as other well-known collapsible table assembly, the table-top itself is generally pivotally disposable into an operative position normally defined by somewhat horizontal orientation.

However, the table top is not generally capable of being stored or positioned in an out-of-sight location after it is disposed in its collapsed orientation. Accordingly, while some structures may in fact be "hidden from view", the structural components supplementing the table top used to accomplish such an out-of-sight disposition is generally cumbersome, overly complexed and obviously adds to the expense of such a structure. It is readily apparent that the versatility and utility of such collapsible table structures are somewhat limited.

For example, a common and practical use for a collapsible table structure would be in a recreational vehicle, trailer, motor home, marine craft, or the like where space is generally limited. However, one problem associated with the use of prior art collapsible tables is their inability to be mounted at a convenient location so that a user could, for example, watch television while eating.

Accordingly, there is a need in the industry for a collapsible table which may vary in specific design, configuration and aesthetic appearance but which has the versatility to be mounted in either a free standing mode or alternately on some type of fixed supporting structure such as a wall or the like. In addition, the versatility of a preferred collapsible table should further be such as to be mounted in a collapsible stored position in a somewhat "out-of-sight" location such as in existing furniture structures. The structural components of a preferred collapsible table therefore should be constructed, dimensioned and designed so as to fit, for example, in the arm or at other hidden locations in a recliner or swivel chair, convertible couch, porch furniture or other more utilitarian furniture structures such as for use in nursing homes or day care centers for the elderly.

SUMMARY OF THE INVENTION

The present invention is directed towards a collapsible table and accompanying support means therefore which enables increased versatility of the subject collapsible table structure. More specifically, the assembly of the present invention comprises a base preferably mounted on a supporting structure, such as a wall or, in other embodiments to be described in greater detail hereinafter, on interior or exterior portions of other furniture such as chairs, couches, etc.

A carriage structure is movable, or more particularly slidable relative to the base and positionable between a retracted, stored position and an outwardly extending position. A table top is pivotally mounted to one exposable surface of the carriage so as to be pivoted into and out of an operative position generally defined by substantially horizontal orientation. In addition, the table top is movable with the carriage structure as it slides between its retracted and outwardly extending position relative to the base. It is important to note, when considering the versatility and utilitarian features of the subject table top assembly, that the table top and carriage may move relative to the substantially fixed base when the table top is in either its operative, horizontally oriented position or its inoperative potentially stored position. In the former position the movement of the table top and carriage structure relative to the base allows an adjustment feature of the table top relative to the normally seated position of the user and further enables adjustment of the table top in a further spaced relation to the user such as when the user wants to move from his seated position but intends to return shortly. In such a situation, the table top is readily extended outwardly a sufficient distance from the furniture to which it is attached so that the user may readily remove himself from the seated position and return thereto without need of collapsing the table to its stored position.

Also, am important feature of the present invention is the ability of the table top, when in its stored, inoperative position, to move with the carriage structure into a somewhat out of sight or "hidden" position. In such an embodiment, the base is disposed in fixed position on an interior portion of a supporting furniture structure, such as in the arm or other applicable portion of the chair, couch, etc. on which the assembly is mounted. This is further made possible due to the fact that the stored, inoperative position of the table top is defined by a substantially immediately adjacent, side-by-side and parallel position of the table top, carriage structure and base wherein such components collectively take up a minimal transverse dimension thereby enabling substantially the entire assembly to fit within a normally designed arm (or other applicable portion) of a conventional chair, couch, etc.

Adequate support is supplied to the table top by virtue of a top support member pivotally mounted on preferably the same exposed surface or face of the carriage as in the table top and positionable between a stored position and an operative supporting position. The supporting position of the top support relative to the table top is defined by an outwardly extending angularly oriented disposition of the top support relative to the carriage and a supporting engagement of an upper longitudinal edge or side of the support with the under portion of the table top.

Another embodiment to be described in greater detail hereinafter includes the table top comprising a plurality of top segments which are pivotal relative to one another and thereby selectively positionable in a folded, stacked orientation on top of one another or a fully outstanding linearly oriented position relative to one another. In the former, folded position of the top segments, the outward extension of the top support may be somewhat less than 90 degrees as it engages the under surface of an exposed top segment along the entire length of the top support. However, when the table top is in its fully extended position, the top support is preferably oriented in a substantially perpendicular relation to the carriage structure as it engages the entire under surface of the plurality of top segments comprising the table top.

Another feature which adds to the versatility and compact nature of the subject assembly is the positioning of the top support in a cut-out or recessed portion integrally formed in the carriage structure and generally conforming to the dimension and configuration of the top support. By virtue of this cooperative structure, the top support, when in its collapsed or stored position, is substantially co-planar with the carriage. The table top, when in its stored, inoperative position overlies both the top support and the aforementioned exposed face or surface of the carriage to which both the table top and the top support are mounted.

In another embodiment of the present invention to be described in greater detail hereinafter, one "specialized" adaptation for the table-top structure of the present invention is its mounting-on a specialized chair, such as a wheel chair. In such an embodiment, the base is fixedly secured to one side of the wheel chair substantially out-board of one of the wheels and the carriage is movable relative thereto along with the attached table-top. The table-top is pivotally disposable relative to the base through a substantially 270 degree arch into overlying and supported relation to the arms of the wheel chair which come in this embodiment defined the top support rather than a separate top support member secured to and movable with the carriage as in the previously described embodiments.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 6:
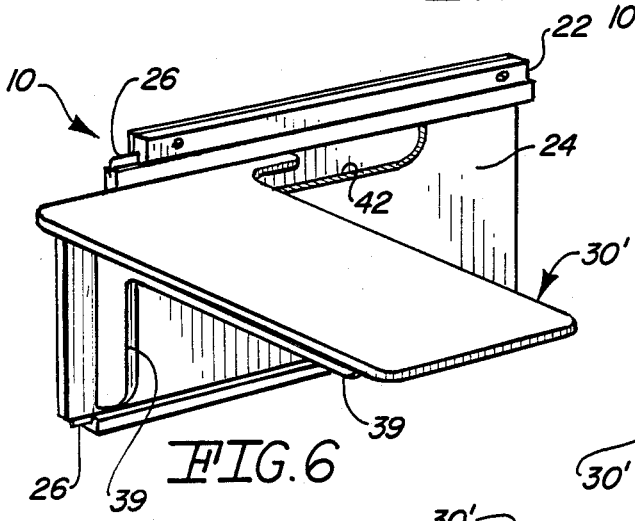
FIG. 6 is a perspective view of another embodiment of the present invention.
Figure 7:
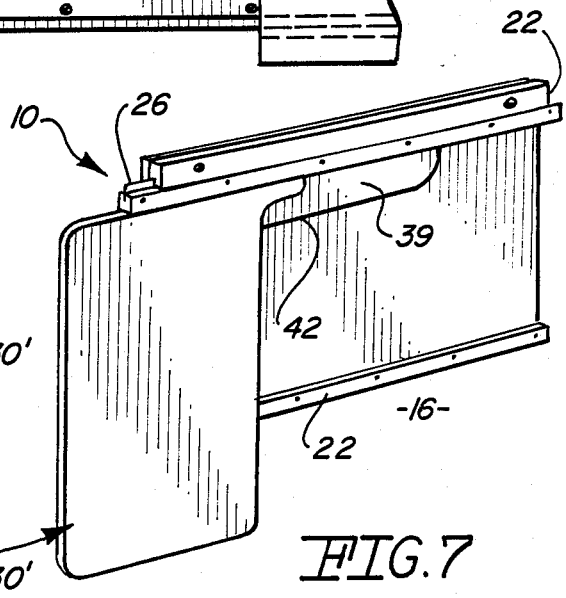
FIG. 7 is a perspective view of said other embodiment of the present invention.
Figure 8:
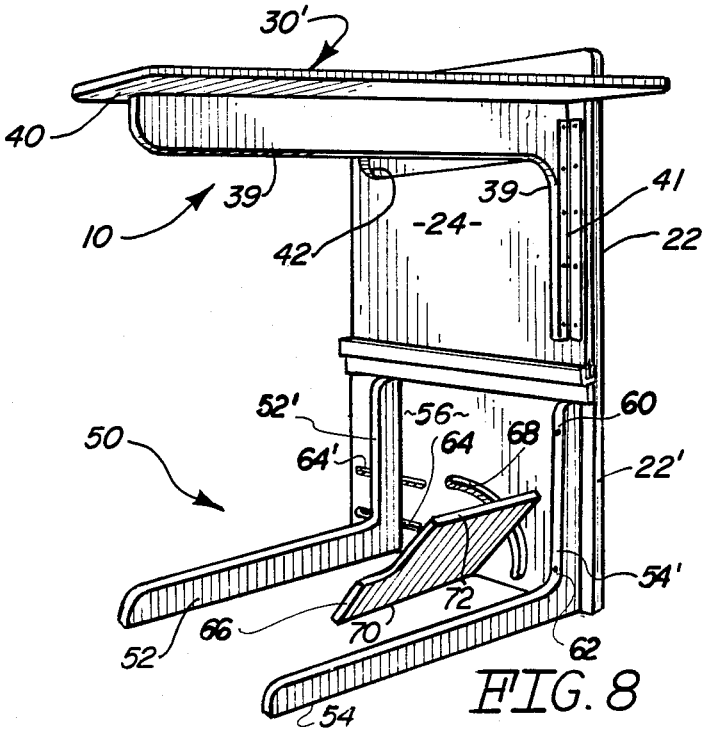
FIG. 8 is a perspective view of another embodiment of the present invention wherein the collapsible table assembly is mounted as free standing.
Figure 9:
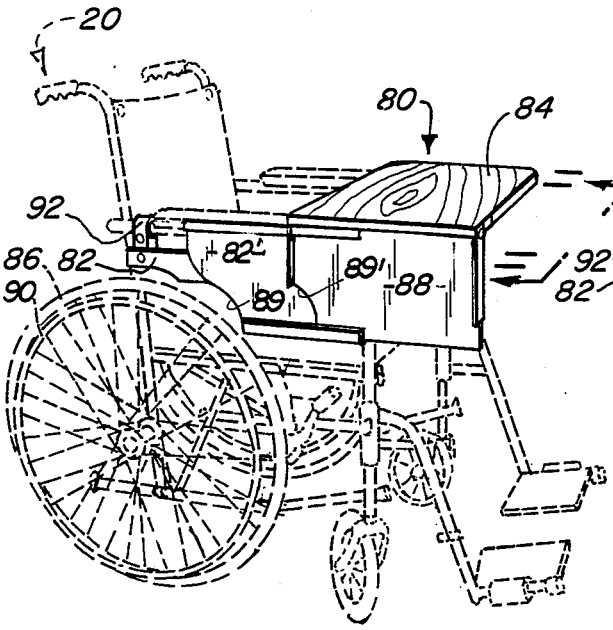
FIG. 9 is a perspective view of another embodiment of the present invention wherein the collapsible table assembly is mounted on a wheel chair for invalids represented in phantom lines.
Figure 10:
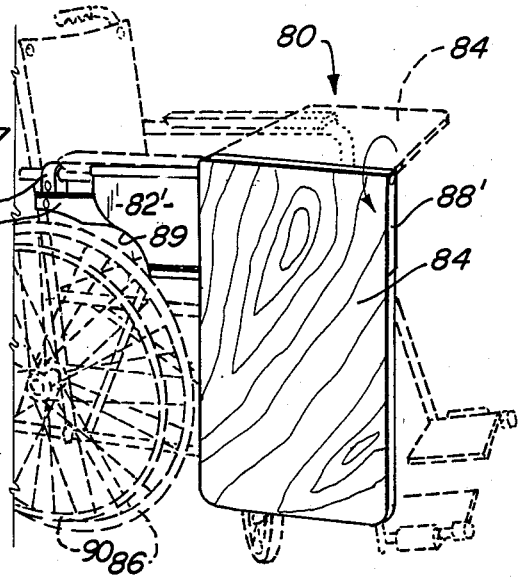
FIG. 10 is a perspective view in partial-phantom showing the table assembly of the present invention in an operative position.
Figure 11:
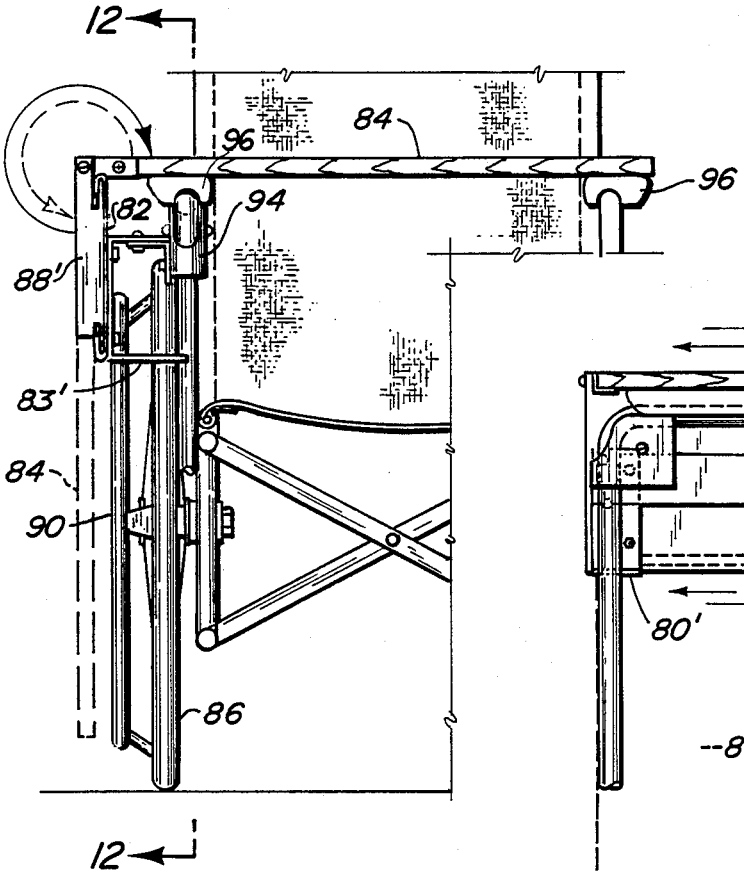
FIG. 11 is a front view in partial cut-away and phantom of the embodiment of FIG. 9.
Figure 12:
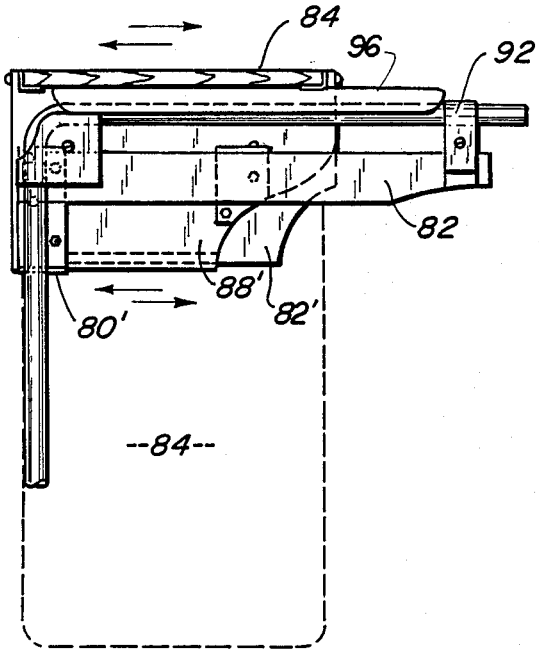
FIG. 12 is a side view of the arm assembly of the wheel chair with structural details relating to the connection of the subject table assembly thereto.

As shown first in FIGS. 1 through 5, the present invention relates to a collapsible table assembly generally indicated as 10 and capable of being secured to a support structure taking a variety of different embodiments. As demonstrated in FIGS. 1 through 5, the support structure includes a substantially conventional piece of furniture such as a chair 12, couch or other support structure wherein the table assembly 10 is removably disposed, when in its stored position, within a hollow portion of the furniture 12 such as in the arm thereof as at 14. In the embodiment of FIGS. 6 and 7, the table assembly 10 is represented as being secured to a support structure representative of a wall or the like generally indicated as 16. In FIG. 8 the support structure to which the table assembly 10 is supportably mounted is an outstanding mount assembly generally indicated as 50. Finally, in FIGS. 9 through 12, the support structure may be a substantially specialized piece of furniture such as a wheel chair for an invalid generally indicated as 20.

Figure 1:
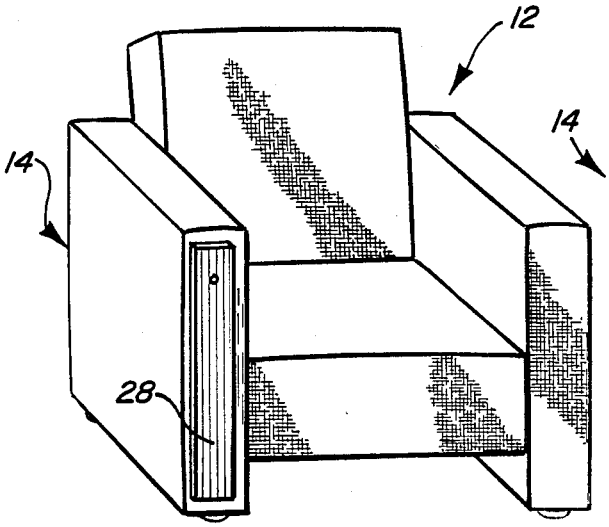
FIG. 1 is a perspective view of a substantially conventional furniture structure incorporating the collapsible table assembly of the present invention in a "hidden" disposition on the interior thereof.
Figure 2:
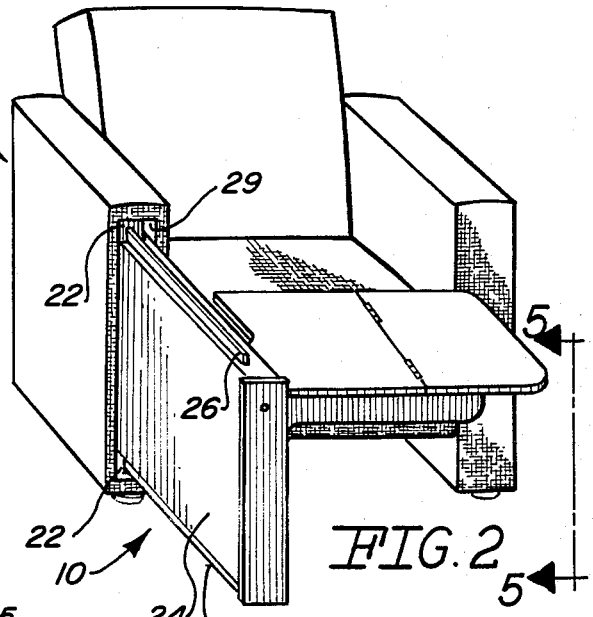
FIG. 2 is the embodiment of FIG. 1 with the collapsible table assembly of the present invention in an operative position.
Figure 3:
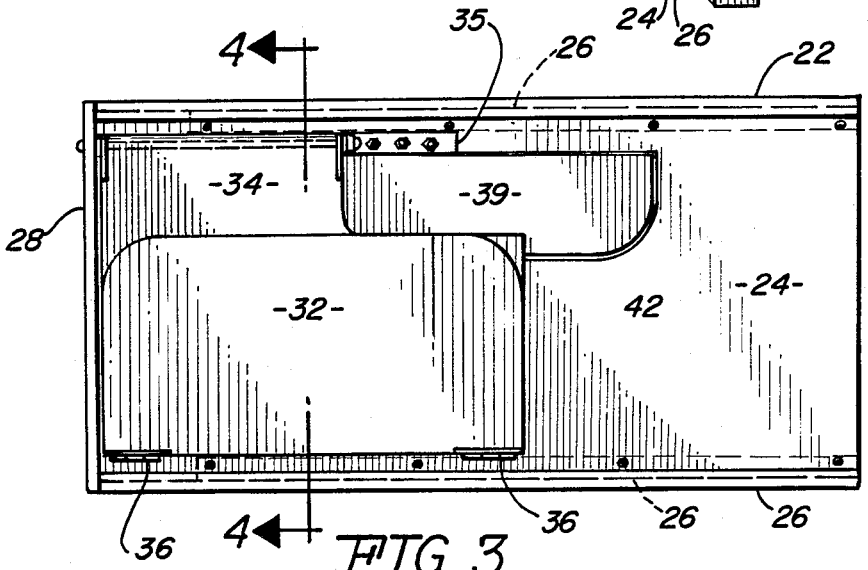
FIG. 3 is a longitudinal side-view with the components of the subject table assembly in a stored position.
Figure 4:
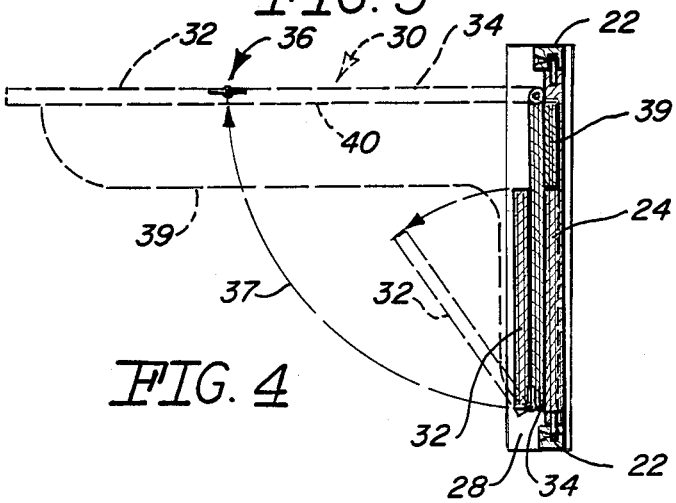
FIG. 4 is a sectional view along line 4—4 of FIG. 3 wherein phantom lines represent operative positioning of certain components of the subject assembly.

With reference to FIGS. 1 through 5, the embodiment of the collapsible table assembly as represented therein includes a base 22, only the end portion of which is viewable in FIG. 2 and represented as 22. A carriage structure 24 is slidably interconnected to the base 22 by track members engaging elongated track slides 26 affixed to opposite longitudinal sides of the carriage 24. A cover panel or like member 28 is secured over the outer or distal end of the carriage 24 and serves as a cover or closure for the aperture 29 formed in the exposed end of the arm 14 through which the carriage passes. A table-top generally indicated as 30, in this embodiment, includes two top segments 32 and 34 pivotally secured to one another by an adequate hinge structure 36 and thereby being capable of being disposed in a folded position as represented in phantom lines in FIGS. 3 and 4 and an open, outwardly extending and substantially horizontally oriented position as represented in phantom lines in FIG. 4. For purposes of clarity, the base and carriage 22 and 24 respectively are shown in a stored or inoperative position in overlying and parallel relation to one another completely removed from the interior of the supporting furniture structure or chair 12.

Figure 5:
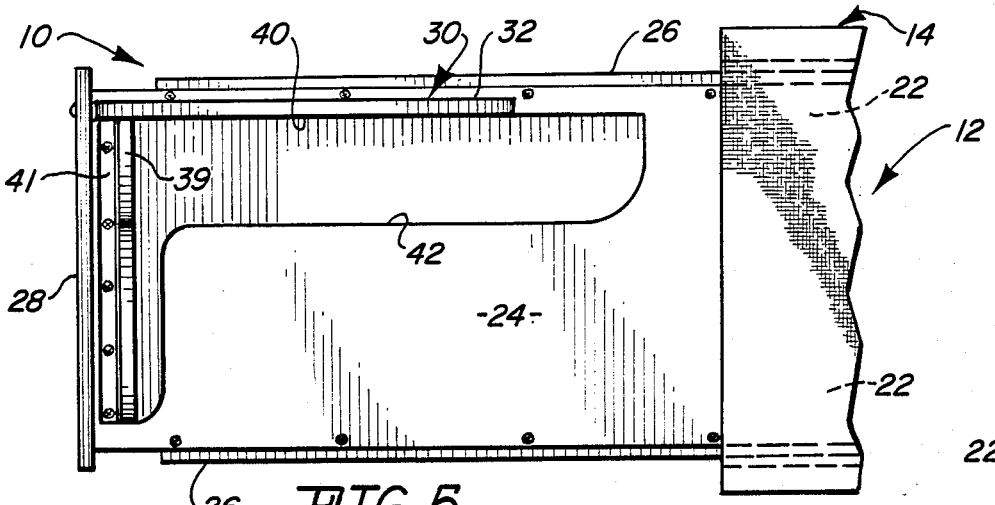
FIG. 5 is a side view of the table assembly in its operative position along line 5—5 of FIG. 2.

As part of the embodiment of FIGS. 1 through 5, a top support is pivotally mounted to extend outwardly from a common surface or face of the carriage 24 as is the table-top 30. More specifically, the table-top including both table segments 32 and 34 are pivotally connected to the inner surface of the carriage 24 by a hinge structure 35 which enables an outward pivotal positioning of the table-top 30 in accordance with directional arrow 37. A top support element has an elongated configuration and is generally indicated as 39 and may be pivotally mounted and positionable outwardly from the common inner surface of the carriage 24 as shown in FIGS. 5 and 6. The top support 39 is secured as by a hinge structure 41 and is pivotal outwardly from the inner surface of the carriage 24 in a direction which is substantially transverse to the directional arrow 37. For purposes of added versatility and compactness in storage, a cut-out portion having an equivalent or congruent dimension and configuration as at 42 is integrally formed in the carriage 24 so as to receive, in co-planar relation to the carriage 24, the support 39. FIGS. 5, 6 and 7, although relating to different substantial embodiments, are perhaps best representative of the top support 39 shown in its operative supporting position relative to an under portion 40 of the table top 30 and out of its stored position relative to the congruently configured and dimensioned recess 42. See FIGS. 5 and 6. FIG. 7 clearly shows the top support 39 shown in its stored and received position relative to the recess 42 and out of engagement with the under surface portion of the table-top 30' (see FIG. 7). In the common embodiment of FIGS. 6 and 7, the table-top 30' is represented as a single piece as versus being defined by at least two table segments 32 and 34 as is the embodiment of FIG. 4.

With regard to the embodiment of FIGS. 6 and 7, such embodiment differs from that of the embodiments of FIGS. 1 through 5 in that the support structure which fixedly engages and has mounted thereon the base 22 is a wall surface 16 rather than a substantially conventional piece of furniture 14 such as a chair, couch, etc. The remaining components including the carriage 24 and the top support 39 however, are very much the same as is the components relating to the slide elements 26 cooperating with the track structures of the base 22 in which they are received.

The embodiment of FIG. 8 defines the support structure for the table assembly 10 as an upstanding mount assembly generally indicated as 50 and designed and dimensioned to fit beneath a conventional chair (not shown for purposes of clarity) and including two support legs 52 and 54 including brace portions 52' and 54' respectively. The legs 52 and 54 are connected to a base extension 22' by virtue of the brace portions 52' and 54'. The base extension 22' is fixedly or integrally secured to and extends downwardly from the conventional base portion 22. As with the above set forth embodiments, the carriage structure is slidable relative to the base 22 in an outwardly extending position (not shown for purposes of clarity) and the table-top 30' is movable with the carriage 24 relative to the base while at the same time being pivotal outwardly into an operative position as shown clearly in FIG. 8 along with the top support 39 supportingly engaging the under portion 40 of the table-top 30'.

The leg brace 54' is fixedly secured to the base extension 56 by conventional connectors such as screws or the like 60 and 62. However, the leg 52 and its accompanying brace 52' is movable latterally along the length of at least one but preferably 2 elongated slots or channels 64 and 64' integrally formed in and extending through the brace extension 56. It should be readily apparent that the space between the legs 52 and 54 may therefore by adjusted by adjusting the position of the leg 52 and accompanying leg brace 52' along the length of the slots 64 and 64'. Two conventional elongated bolts may be formed on the confronting edge of the leg brace 52' and extend through the slots 64 and 64' to the opposite side of the base extension 56 (not shown) wherein it may be engaged by thumb screws also not shown for purposes of clarity. Tightening of the thumb screws relative to the elongated bolts or the like will fix the leg 52 and leg extension 52' in the desired position along the length of the channels 64 and 64'.

To add further stability, an additional support brace 66 may be rotatably or pivotally adjusted along the length of a curved channel or groove 68 by similar elongated connector and thumb screw protruding through the curved channel 68 and out from the opposite surface of the base extension 56 (not shown). The lower longitudinal edge as at 70 may engage the floor, carpet or other supporting surfaces on which the legs 52 and 54 are supported. The angular orientation of the support brace 66 may be adjusted such that the upper longitudinal edge 72 may engage the under portion of the chair (not shown for purposes of clarity) under which the legs 52 and 54 are positioned, as set forth above. Accordingly, a stability and an effective gripping or "hugging" action between the support brace 66 and the under portion of the chair (not shown) will occur thereby clearly preventing any tendency for the assembly as pictured in FIG. 8 to tip over from its upright orientation. Dismantling of the structure, for purposes of shipping or compact storage, merely involves the removal of the legs 52 and 54 and the support brace 66 by removing the appropriate connectors which serve to connect or mount the respective legs 52, 54 and support brace 66 in their operative position as shown in FIG. 8.

The additional embodiment of the collapsible table assembly of the present invention is represented in FIGS. 9 through 12 as 80 and has the support structure for the assembly in the form of a wheel chair 20. The assembly 80, similar to the embodiments as set forth above, includes a fixed base 82 which has an outward extension 82' supported by a brace 83 with a transverse dimension or thickness sufficient to position the table-top 84, when in its folded or stored position, outboard of the correspondingly positioned wheel 86 of the collapsible table assembly 80. As in the other previous embodiments, the table-top 84 is pivotally secured to and movable with the carriage assembly 88 which in turn is slidable relative to the base 82 by appropriately positioned and configured and cooperatively structured track members located on both longitudinal sides of the base 82 and carriage 88. The structure, dimension and configuration of the carriage is such as to be positioned out-board of the correspondingly positioned wheel 86 and in a non-interfering position relative to the occupant of the chair when manipulating the hand ring 90 of the wheel 86. Also the correspondingly positioned ends 89 of the base portion 82' and 89' of the carriage 88 may have a substantially curvilinear cut-out portion so as to prevent interference between the hand or arm of the occupant of the chair as he grasps the correspondingly positioned wheel 86 and more specifically the hand ring 90 thereof for propulsion of the chair. The assembly shown in the figures relating to the wheel chair may include the base, carriage and other operable components being formed of a sheet metal or other substantially light-weight material which is easy to form but yet provides adequate structural integrity to maintain the table-top 84 in either an operative or inoperative position. Also in this embodiment, it is important to note that when the table-top 84 is in its inoperative position and folded in substantially parallel relation to the correspondingly positioned wheel 86, it is preferably no more than approximately three quarters of an inch distance spaced outwardly from the wheel. This distance is well within the conventionally well-accepted parameter for door widths now becoming a part of the ordinance or code in most communities for the passage of wheel chairs and other handicapped equipment for invalids. Appropriate brackets and like structures as at 92 and 94 are specifically configured and structured to fixedly secure the assembly to one of the arms of the wheel chair preferably on opposite sides of the arm pads 96.

It is also important to note that in this embodiment, the top support is defined by the arms or arm pads 96 themselves rather than any specific outwardly extending and pivotally oriented arm-like structure as discussed with the embodiments as set forth above. As with the support structure in the previous embodiment, the plurality of arms serve in supporting engagement with under-portions of the table-top. The fact that the table-top is pivotal some approximately 270 degrees from its folded position into its operative position (see FIG. 11) but still movable with the carriage allows versatility in adjustment of the table-top relative to one seated in the wheel chair while the table-top 84 is in its operative position.

Now that the invention has been described,

What is claimed is:

1. A collapsible table assembly designed for selective disposition between an operative and an inoperative position, said assembly comprising:

a. a base fixedly secured to a supporting structure and having a substantially elongated configuration along at least one dimension thereof, b. a carriage structure movably mounted on said base in substantially parallel relation thereto and selectively disposable between a retracted position and an outwardly extending position relative to said base, c. a table-top pivotally connected to said carriage structure and movable therewith relative to said base, said table-top movable between said operative position defined by an outwardly extending transverse and substantially horizontal orientation relative to said carriage structure and said inoperative position defined by a parallel, side-by-side orientation relative to said carriage structure, d. a top support having an elongated configuration and pivotally mounted on said carriage structure and movable therewith relative to said base, said top support positionable beneath and in supporting engagement with an under surface of said table top, and e. said inoperative position further defined by said top support and said carriage structure disposed in parallel relation to said table top and said carriage structure disposed in said retracted position in substantially overlying relation to at least a major portion of said base, f. said carriage structure comprises a cut-out portion formed therein and dimensioned and configured to receive said top support therein in substantially co-planar relation said carriage structure when in said inoperative position.

* * * * *